US005425255A

United States Patent [19]

Pick

[11] Patent Number: 5,425,255

[45] Date of Patent: Jun. 20, 1995

[54] WASHING MACHINE FILL SYSTEM

[75] Inventor: James M. Pick, Elk Grove Village, Ill.

[73] Assignee: Eaton Corporation, Cleveland, Ohio

[21] Appl. No.: 194,542

[22] Filed: Feb. 10, 1994

[51] Int. Cl.[6] ..... D06F 39/08

[52] U.S. Cl. ..... 68/207; 29/434; 137/343

[58] Field of Search ..... 68/207; 137/343, 359; 29/434, 469

[56] References Cited

U.S. PATENT DOCUMENTS

| | | | |
|---|---|---|---|
| 2,523,801 | 9/1950 | Woodson | 68/207 X |
| 3,153,924 | 10/1964 | Alger | 68/207 X |
| 3,301,022 | 1/1967 | Low | 68/207 X |
| 3,381,700 | 5/1968 | Frymark | 68/207 X |

FOREIGN PATENT DOCUMENTS

| | | | |
|---|---|---|---|
| 87591 | 5/1986 | Japan | 68/207 |

*Primary Examiner*—Philip R. Coe
*Attorney, Agent, or Firm*—Roger A. Johnston

[57] ABSTRACT

A fill system for a washing machine utilizing a hot and cold water inlet mixing valve operated by a pair of solenoids extending in parallel arrangement from a deck surface of the valve body. At least one hot and cold water inlet fittings extend in parallel arrangement from a common side of the valve body and the single outlet extends from another side of the body. The valve is mounted with deck surface contacting the undersurface of the top of the machine cabinet with the solenoids extending through an aperture in the cabinet top and into the machine control console. The inlet fittings extend through an aperture in the back of the machine cabinet. The solenoids are thus isolated from and protected from water leaks resulting from hose attachments to the fittings.

10 Claims, 1 Drawing Sheet

FIG. 1
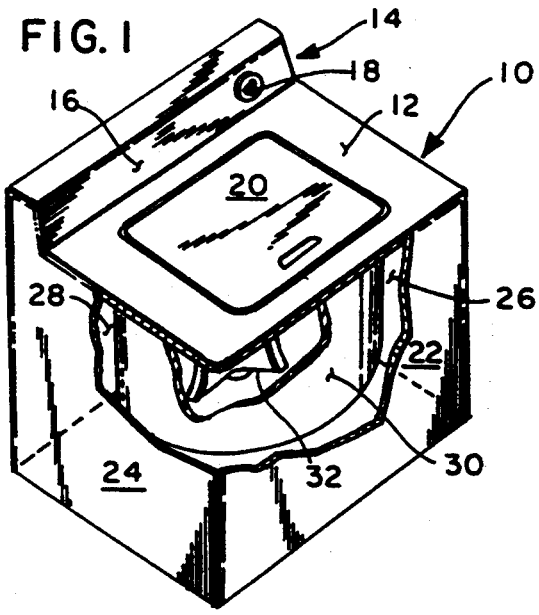
FIG. 2
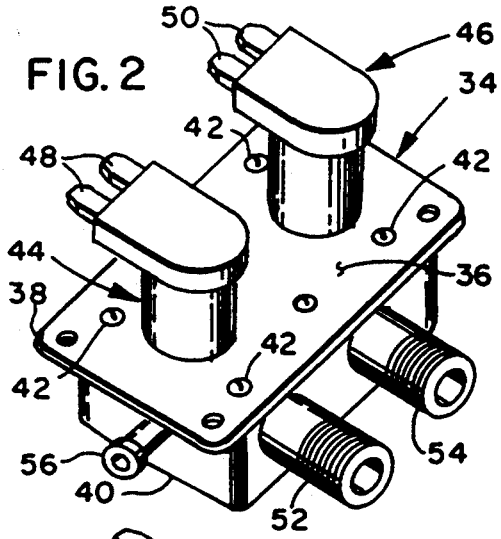
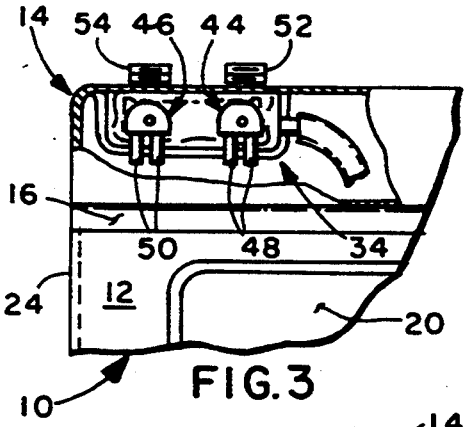
FIG. 3
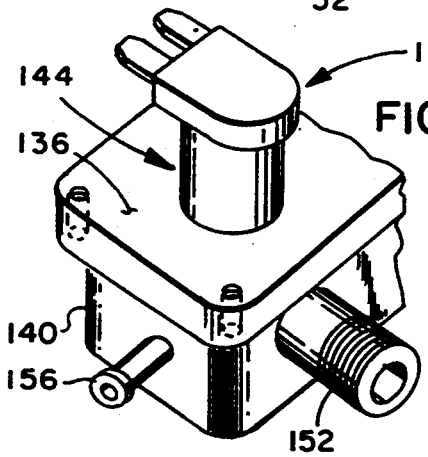
FIG. 6
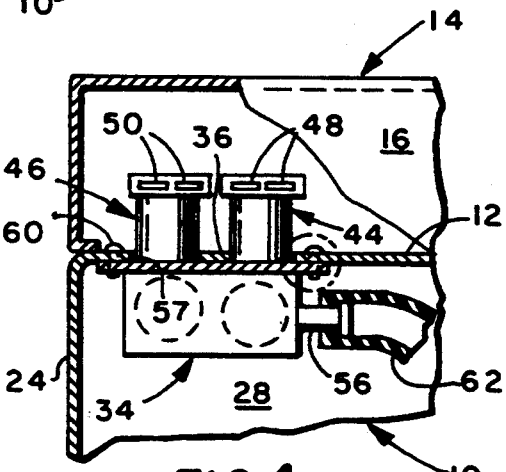
FIG. 4
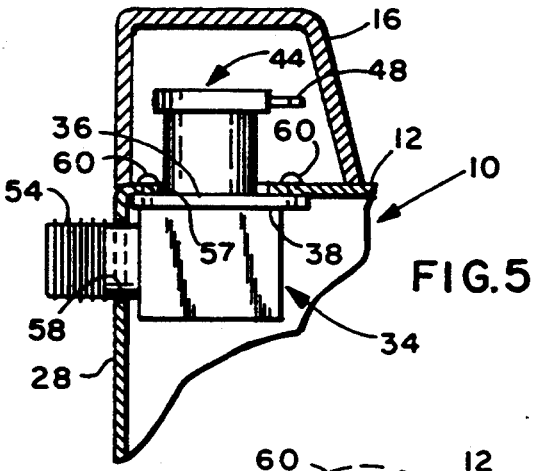
FIG. 5
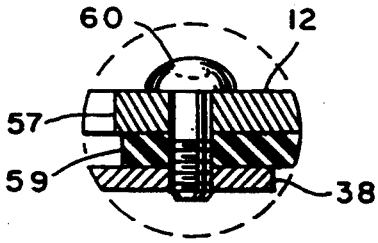
FIG. 7

WASHING MACHINE FILL SYSTEM

BACKGROUND OF THE INVENTION

The present invention relates to water fill systems for automatic washing machines and particularly machines of the type having a receptacle filled with water and having a motorized agitator for moving the articles immersed in the water for washing. Washing machines of this type typically have an inlet valve with dual inlets for individual connection to a source of heated and cold Water to provide mixing and a flow tempered water for washing in the receptacle. The inlet mixing valves commonly employed for a washing machine are of the type electrically actuated with individual solenoid operators for opening the inlet for the heated and/or cold water. The valves have a single outlet for the tempered water discharged to the washing receptacle or tub.

In providing for the manufacture of automatic washing machines, it has heretofore been the practice to mount the electrically operated water inlet mixing valve on the machine cabinet or housing with the inlet fittings extending therethrough for connection to externally of the machine to the hot and cold water sources. This has required wiring connections from the electrically operated mixing valve to the programmer timer for controlling the washing machine cycle of operations. Typically, the programmer and timer controls are located above the machine top deck in a console; whereas, the electrically operated water valve is located below the top deck in the region adjacent the washing receptacle and is thus subject to moisture and water from hose leakages and receptacle overflow. Thus, it has been desired to provide a way or means of preventing the wiring connections to the electrically operated water inlet valve in a washing machine in a manner which protects the electrical connections from moisture and water leaks which would result in electrical shorting and result in premature failure of the coil.

SUMMARY OF THE INVENTION

The present invention provides a unique and novel way of mounting an electrically operated water inlet mixing valve in a washing machine such that the electrical connections are isolated from the chambers of the machine connected to the water supply and yet provide tempered water at the valve outlet for discharge into the washing receptacle of the machine. The water inlet mixing valve of the present invention has individual solenoids for operating separate hot and cold water valve members; and, the solenoids extend outwardly from the mounting deck surface provided on the valve. The mounting deck may either comprise a plate attached to the valve body or a surface molded integrally in the valve body around the solenoids. The separate hot and cold inlet fittings and tempered water discharge fitting extend from the valve body in the region below the mounting deck surface. The valve is mounted to the undersurface of the machine cabinet top deck with the solenoids extending upwardly through an aperture formed in the machine deck into the control console of the machine which is located above the top deck. The separate inlet fittings for the valve extend outwardly of the machine cabinet through an aperture provided in one wall of the machine cabinet. The valve mounting deck may be sealed about the undersurface of the machine cabinet top deck to therefor prevent moisture or water discharge from a broken fitting or a hose from entering the chamber containing the electrical connections to the valve solenoids.

The present invention thus provides a unique and low cost technique for mounting a dual solenoid water inlet mixing valve into a washing machine cabinet directly in a manner which isolates the solenoids and their attendant electrical connections from the chambers connected to the water inlet and outlet fittings.

BRIEF DESCRIPTION OF THE DRAWINGS

FIG. 1 is an axonometric view of a washing machine with portions of the cabinet broken away;

FIG. 2 is an axonometric view of a dual solenoid water inlet mixing valve for the machine in FIG. 1;

FIG. 3 is a top view of the machine of FIG. 1 with portions of the console cover broken away;

FIG. 4 is a front elevation view of the machine of FIG. 1 with portions of the cabinet broken away to show the valve mounted in the cabinet;

FIG. 5 is a side elevation view from the left side of the machine of FIG. 1 with portions of the cabinet broken away; and, FIG. 6 is a view similar to FIG. 2 of an alternate version of the water inlet valve; and, FIG. 7 is an enlarged view of the portion encircled in dashed outline in FIG. 4.

DETAILED DESCRIPTION

Referring to FIG. 1, a typical top loading washing machine is illustrated generally at 10 as having a top deck 12 with a control console extending upwardly therefrom at the rear thereof as indicated generally at 14 with a control panel 16 having user operated controls such as program setting knob 18 extending therefrom. The top deck 12 has a hinged cover or lid 20 which is user openable for loading therein articles to be washed.

The machine cabinet has a front panel 22, left side panel 24 right side panel 26 with a back panel 28. The machine has a washing tub or receptacle 30 having a motorized agitator 32 provided therein it will be understood that the programmer/timer and controls for operating the agitating motor and other machine functions are disposed within the control console 14 above the top deck 12 of the cabinet 10.

Referring to FIGS. 2–5, a water inlet mixing valve indicated generally at 34 has a mounting deck surface 36 which in the embodiment of FIG. 2 comprises a deck plate 38 attached to the valve body 40 by fasteners such as self-tapping screws 42. The valve 34 has a pair of solenoid operators extending upwardly from the mounting surface 36 as indicated generally by reference numerals 44,46 each of which has a pair of preferably bayonet type electrical connecting terminals indicated respectively at reference numerals 48,50.

The valve body 40 has separate hot and cold water inlet fittings denoted by reference numerals 52,54 extending from a common side of the body 40 and at right angles to the solenoid operators 44,46 and which are of the type threaded for hose connection thereto. The valve block has a common outlet fitting 56 for providing discharge of tempered, hot or cold water depending upon the sequence and duration of energization of the solenoids 44,46. The outlet fitting also extends at right angles to the solenoids 44,46 and from a face of the body adjacent the common inlet side.

Referring to FIGS. 3, 4 and 5, the top deck 12 of the cabinet 10 has an aperture 57 formed therein; and, the back panel 28 of the cabinet 10 has an aperture 58 formed therein. The valve is installed with the solenoids 44,46 received through the aperture 57 in the deck plate 12 and the inlet fittings 52,54 received through the aperture 58 in the back panel 28. The deck surface 36 of the valve is registered against the under surface of the cabinet top deck 12; and, the valve is secured in place by suitable fasteners such as, for example, screws 60 threaded into the deck plate 38. If desired, a resilient seal denoted by reference numeral 59 in FIG. 4 and FIG. 7 may be employed between the valve deck 36 and undersurface of top 12 of the cabinet. The outlet fitting 56 of the valve is connected to a hose 62 which is positioned for discharging into the wash tub or receptacle 30.

Referring to FIG. 6, an alternate embodiment of the mixing valve is indicated generally at 134 and has a body 140 a portion of which is shown in FIG. 6 and which has molded integrally therewith a mounting deck 136 upon which is mounted the solenoid coils or operators one of which is shown in FIG. 6 and indicated generally at 144. The valve has the inlets thereof disposed in parallel arrangement from one side, one of which is illustrated and denoted by reference number 152 in FIG. 6. The outlet of the valve 134 is disposed at right angles from the end of the valve as denoted by reference numeral 156. It will be understood that the valve of FIG. 6 may be mounted to the washing machine cabinet 10 in the same manner as is illustrated in FIGS. 3, 4 and 5. The present invention thus provides a low cost and convenient way of mounting a water inlet mixing valve in a washing machine such that the electrical operators for the individual valving operations are disposed above the top deck of the machine cabinet and housed in the control console. The body of the valve and the inlet and outlet fittings are disposed below and sealed against the undersurface of the top deck of the machine and thus the electrical connections are isolated and protected from the hose connections to the valve inlet and outlet and overflow from the tub.

Although the present invention has hereinabove been described with respect to the embodiments illustrated in the drawings, it will be understood that the invention is capable of modification and variation and is limited only by the following claims.

I claim:

1. A water fill system for an automatic clothes washing machine comprising:

(a) a cabinet structure defining front, back and side walls enclosing a washing receptacle and a top deck disposed above said receptacle and agitator means for effecting automatic washing in said receptacle;

(b) console means mounted on said top deck and enclosing controls for operating said agitator means, said console means defining a control panel operable for receiving user input to said controls;

(c) electrically operated mixing valve means having body means with at least one individual inlet connector adapted for connection to sources of hot and cold water and an outlet fitting, said valve means including a plurality of solenoid operators, said solenoid operators disposed in side by side arrangement and generally at right angles to said inlet connectors; said body means having a deck surface from which said solenoid operators extend;

(d) said cabinet back wall having a cut-out formed therein adjacent said top deck, with said top deck having a cut-out formed therein adjacent said back wall cut-out;

(e) said valve means mounted with said deck surface adjacent the underside of said top deck with said solenoid operators extending through said top deck cut-out and said inlet connections extending through said back wall cut-out, wherein said valve means outlet is disposed below said top deck and adjacent said receptacle and said solenoid operators are disposed within said console means for electrical connections thereto.

2. The system defined in claim 1, wherein said top deck cut-out includes a seal between said top deck and said valve body means deck surface for preventing water leakage into said console means.

3. The system defined in claim 1, wherein said valve means body is formed of plastic and said deck plate is formed of metal.

4. The system defined in claim 1, wherein said deck surface is attached to said top deck by threaded fasteners.

5. The system defined in claim 1, wherein said inlet connectors each have external threads formed thereon and are adapted for threaded hose connection thereto.

6. The system defined in claim 1, wherein said solenoid operators each have a pair of bayonet type electrical connection terminals formed thereon.

7. The system defined in claim 1, wherein said valve means outlet has a flexible hose attached thereto for discharging into said washing receptacle.

8. The system defined in claim 1, wherein said valve body means includes a plate member removably attached to said body means and said plate is mounted against the underside of said top deck.

9. A method of making an automatic washing machine comprising:

(a) providing a machine cabinet having a top deck, spaced sides, a front wall and a back wall and enclosing a washing receptacle therein;

(b) providing a control console with a user control panel on the top deck and housing the machine controls in the console;

(c) providing an electrically operated water inlet mixing valve having a body with a mounting deck and at least one inlet fitting extending from a side thereof and at least one solenoid operator extending from the mounting deck and an outlet fitting extending from another side of the body;

(d) forming an aperture in the cabinet back wall adjacent the top deck and forming an aperture in the cabinet top deck adjacent the back wall and communicating with the control console;

(e) inserting said at least one valve inlet fitting through said back wall aperture and inserting at least one solenoid operator through said top deck aperture and attaching said valve mounting deck against the undersurface of said cabinet top deck;

(f) connecting said outlet fitting to a hose and disposing said hose for discharge into said receptacle; and, (g) connecting said at least one solenoid operator to said controls.

10. The method defined in claim 9 wherein said step of attaching said valve mounting deck includes sealing said mounting deck about said aperture.

* * * * *